United States Patent [19]

Crowell

[11] Patent Number: 4,961,468

[45] Date of Patent: Oct. 9, 1990

[54] MULTI-FUNCTION CONTROL ACTUATING MECHANISM

[75] Inventor: James M. Crowell, Providence, Ky.

[73] Assignee: Pyro Mining Company, Sturgis, Ky.

[21] Appl. No.: 390,780

[22] Filed: Aug. 8, 1989

[51] Int. Cl.[5] ..... E21B 15/04

[52] U.S. Cl. ..... 173/39; 173/42; 175/113

[58] Field of Search ..... 173/39, 43, 42, 141; 175/113, 114, 121, 122, 202

[56] References Cited

U.S. PATENT DOCUMENTS

| | | | |
|---|---|---|---|
| 2,683,587 | 7/1954 | Gunning . | |
| 2,801,618 | 8/1957 | Place et al. . | |
| 3,080,007 | 3/1963 | Long et al. . | |
| 3,375,880 | 4/1968 | Pyles et al. . | |
| 3,409,252 | 11/1968 | Miller . | |
| 3,768,574 | 10/1973 | Long . | |
| 3,842,610 | 10/1974 | Willis et al. . | |
| 4,197,908 | 4/1980 | Davis et al. . | |
| 4,234,155 | 11/1980 | Destree | 173/43 X |
| 4,291,780 | 9/1981 | Fulkerson | 173/39 X |
| 4,453,773 | 6/1984 | Toffolon | 173/43 X |
| 4,470,570 | 9/1984 | Sakurai et al. . | |
| 4,531,080 | 7/1985 | Nordström . | |

*Primary Examiner*—Frank T. Yost
*Assistant Examiner*—Willmon Fridie, Jr.

[57] ABSTRACT

A multi-function control actuating mechanism for a roof drilling and bolting machine includes an actuating rod having a first end and a second end. The actuating rod is of a predetermined length and is mounted for movement in a longitudinal direction. A sleeve includes a first end and a second end. The sleeve is mounted for limited rotational movement and is positioned around the actuating rod and extends along a portion of the length thereof. A first bracket is secured adjacent to a first end of the sleeve. A second bracket is secured adjacent to a second end of the sleeve. An actuating lever is operatively connected to the second bracket and to a second end of the actuating rod. Wherein selectively imparting movement in a first direction to the actuating lever imparts longitudinal movement to the actuating rod and selectively imparting movement in a directional orthogonal to the first direction imparts limited rotational movement to the second bracket, the sleeve and the first bracket for providing a multi-function control actuating mechanism for a roof drilling and bolting machine.

10 Claims, 4 Drawing Sheets

MULTI-FUNCTION CONTROL ACTUATING MECHANISM

BACKGROUND OF THE INVENTION

1. Field of the Invention

The present invention is directed to a multi-function control actuating mechanism for controlling the lifting of a boom member and the rotation of a pot in a roof drilling and bolting machine.

2. Description of Background Art

Hithertofore, roof drilling and bolting machines included a plurality of levers for operating the boom and pot. A single individual lever would be utilized for raising and lowering the boom. Similarly, a single individual lever would be utilized for imparting rotational movement to the boom. Thus, both hands of an operator are required in order to raise the boom and rotate the pot during a roof drilling and/or bolting operation.

SUMMARY AND OBJECTS OF THE INVENTION

It is an object of the present invention to provide a multi-function control actuating mechanism for a roof drilling and bolting machine wherein an actuating lever is utilized for controlling both the longitudinal movement imparted to an actuating rod and the rotary movement imparted to a sleeve.

The multi-function control actuating mechanism permits an operator to operate the roof drilling and bolting machine by only utilizing a single hand. Thus, the operator's other hand is available for other operations.

It is an object of the present invention to provide an actuating rod which is mounted for longitudinal movement for imparting motion to a boom lifting actuator for raising and/or lowering a boom.

Another object of the present invention is to provide a sleeve mounted around the actuating rod and extending along a portion thereof. Imparting limited rotational movement to the sleeve imparts movement to a rotational actuator for rotating a pot either clockwise or counterclockwise depending on the direction of rotation of the sleeve.

These and other objects of the present invention are accomplished by providing a multi-function control actuating mechanism for a roof drilling and bolting machine which includes an actuating rod having a first end and a second end. The actuating rod is of a predetermined length and is mounted for movement in a longitudinal direction. A sleeve includes a first end and a second end. The sleeve is mounted for limited rotational movement and is positioned around the actuating rod and extends along a portion of the length thereof.

A first bracket member is secured adjacent to a first end of the sleeve. A second bracket member is secured adjacent to a second end of the sleeve. An actuating lever is operatively connected to the second bracket and to a second end of the actuating rod. An operator selectively, manually imparting movement in a first direction to the actuating lever imparts longitudinal movement to the actuating rod. In addition, selectively, manually imparting movement in a direction orthogonal to the first direction imparts limited rotational movement to the second bracket member, the sleeve and the first bracket member for providing a multi-function control actuating mechanism for a roof drilling and bolting machine.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
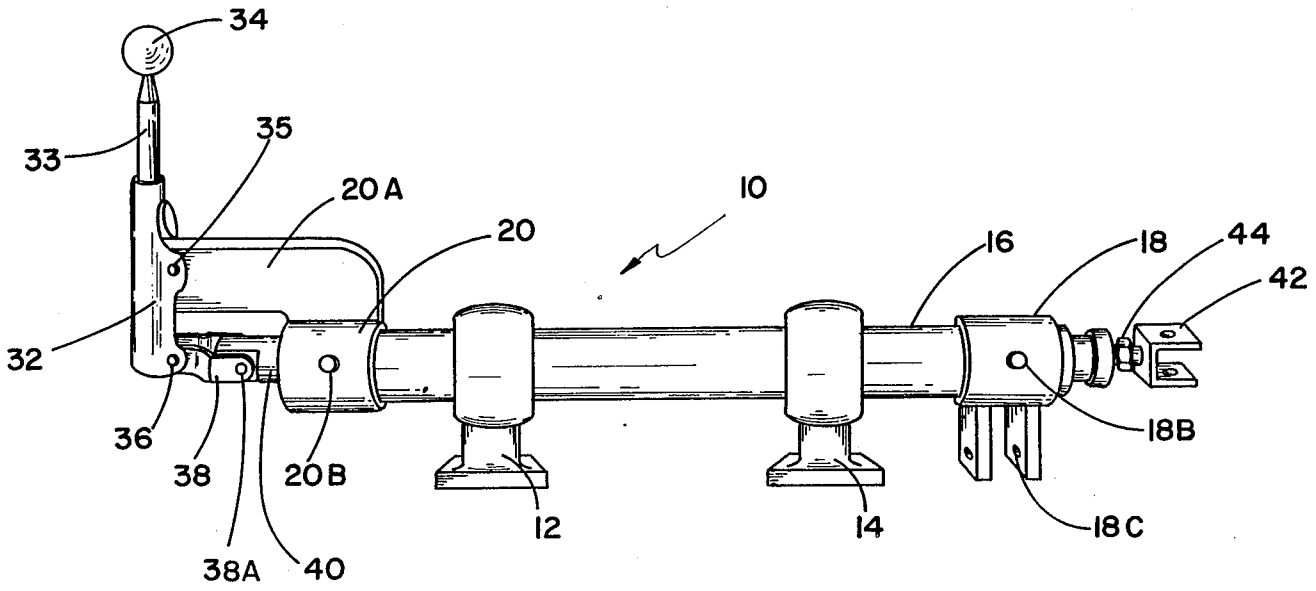
FIG. 1 is a side elevational view of a multi-function control actuating mechanism according to the present invention.
Figure 2:
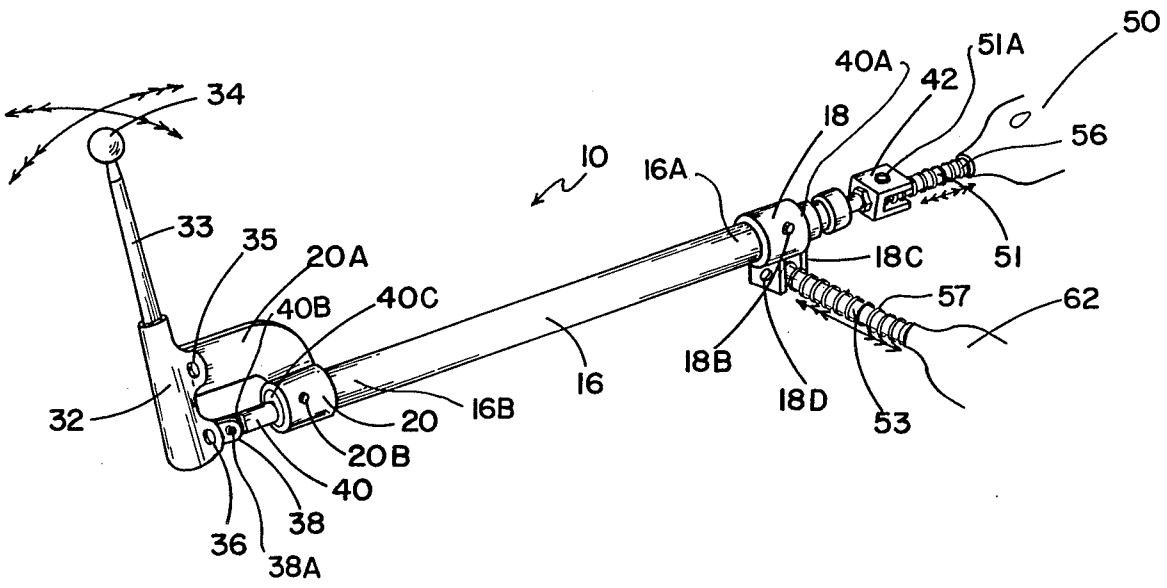
FIG. 2 is a perspective view of the multi-function control actuating mechanism of the present invention and illustrating the connection of a boom lift actuator and a rotational actuator.
Figure 3:
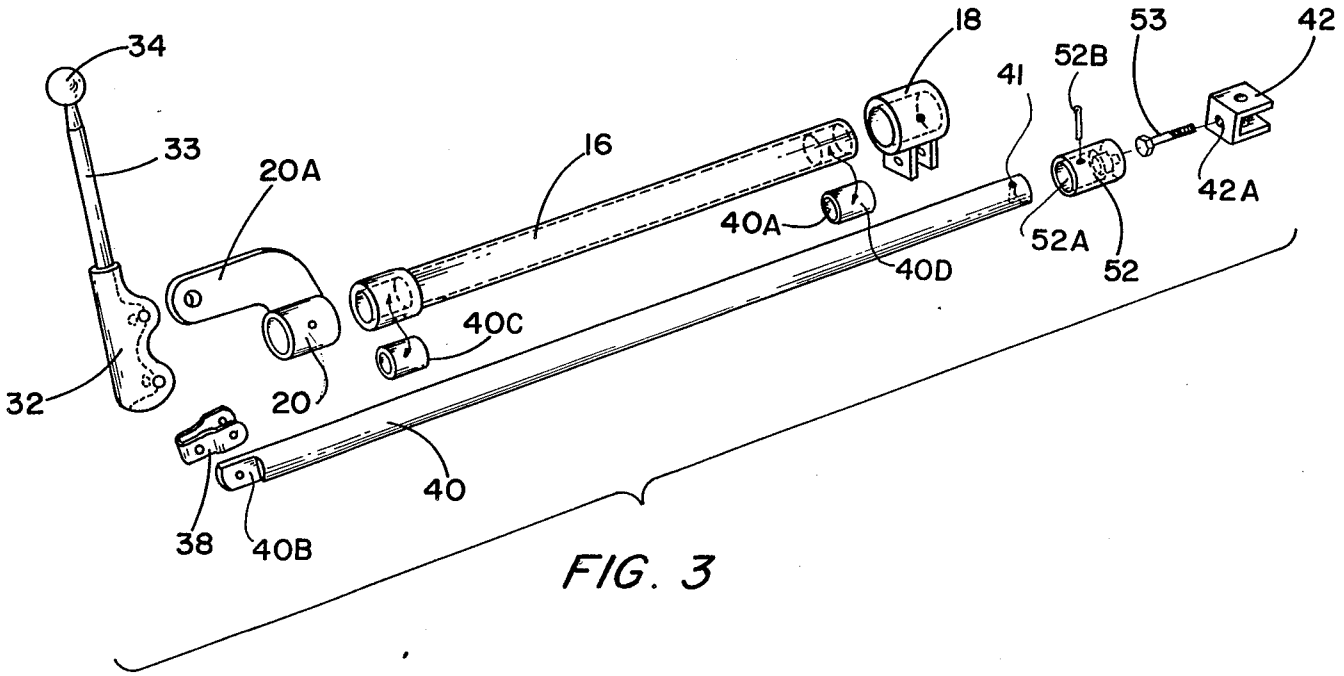
FIG. 3 is an exploded view of the multi-function control actuating mechanism of the present invention.
Figure 4:
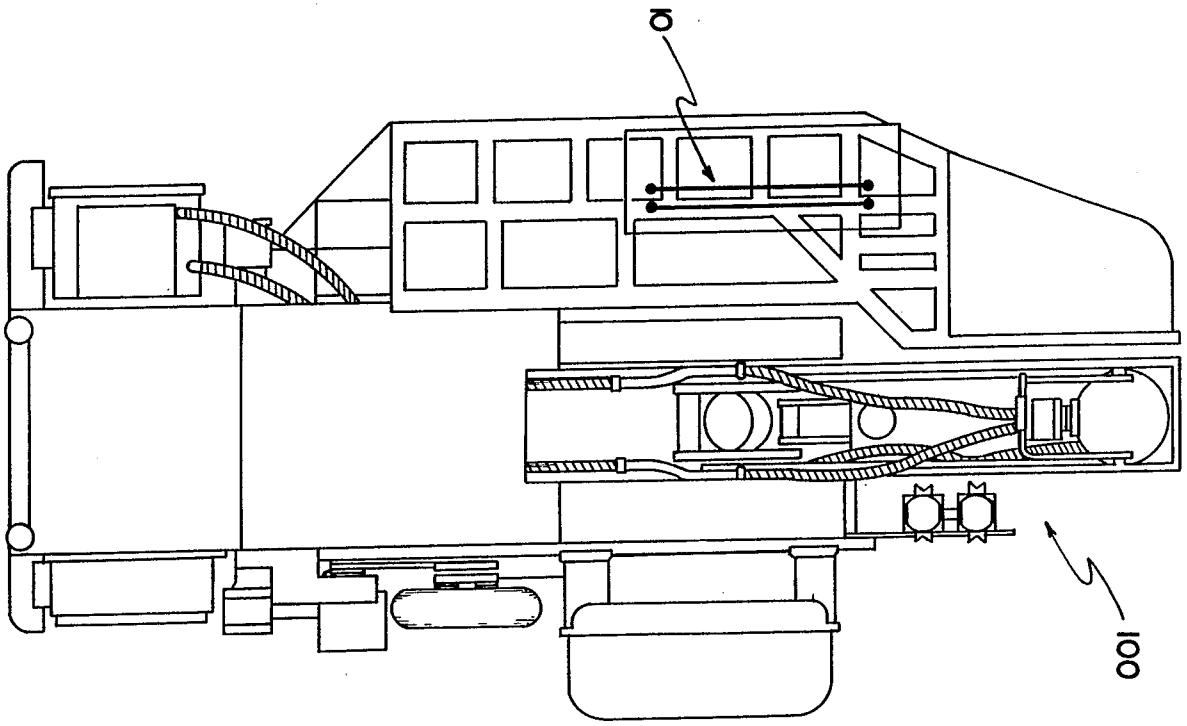
FIG. 4 is a schematic view showing the location of the control lever of the present invention in a roof drilling and bolting machine.

As illustrated in FIGS. 1–3, a multi-function control actuating mechanism 10 includes a first support 12 and a second support 14. The first support 12 and the second support 14 are mounted on a housing of a roof drilling and bolting machine 100 which is schematically illustrated in FIG. 4.

The multi-function control actuating mechanism 10 includes an actuating rod 40 which includes a first end 40A and a second end 40B. A sleeve 16 is mounted around the actuating rod 40 and includes a first end 16A and a second end 16B.

A bracket 18 is mounted on the first end 16A of the sleeve 16. Similarly, a bracket 20 is mounted on the second end 16B of the sleeve 16. The bracket 18 includes flange members 18C projecting outwardly therefrom. A set screw 18B is utilized to securely affix the bracket 18 relative to the sleeve 16.

The bracket 20 mounted on the second end 16B of the sleeve 16 is secured relative thereto by means of a set screw 20B. An outwardly extending arm 20A is mounted to the bracket 20. A connecting arm 32 is secured to the arm 20A by means of a connecting pin 35. A lever 33 is secured to the connecting arm 32. A lever knob 34 is affixed to an outwardly projecting end of the lever 33.

A coupling 38 is secured to the connecting arm 32 by means of a connecting pin 36. In addition, the coupling 38 is secured to the second end 40B of the actuating rod 40 by means of a connecting pin 38A.

Bushings 40C, 40D are mounted within the sleeve 16 to permit longitudinal and rotational movement of the sleeve 16 relative to the actuating rod 40. A union 52 is mounted to the first end 40A of the actuating rod 40. The union 52 includes an aperture 52A disposed within the thickness of the union 52. The union 52 is secured to the first end 40A of the actuating rod 40 by means of a pin 52B. A securing bolt 53 is designed to be mounted within the aperture 52A of the union 52 and project outwardly therefrom. A coupling 42 is designed to include an aperture 42A through which the threaded portion of the bolt 53 extends. In this manner, the union 52 can be securely retained relative to the actuating rod 40.

A boom lift actuator 50 includes a rod 51 secured to the coupling 42 by means of the bolt 51A. In addition, a rotational actuator 62 includes a rod 53 secured to the flange 18C by means of a connecting pin 18D.

A spring 56 is mounted around the rod 51 for returning the actuating rod 40 to a neutral position after a manual force is released from the lever 33. Similarly, a spring 57 is mounted around the rod 53 for returning the bracket 18 to a neutral position after a manual force is released from the lever 33.

In operation, an operator applies a manual force to the lever knob 34 and the lever 33 to move the actuating rod 40 in a longitudinal direction. Moving the actuating rod 40 in a first longitudinal direction imparts movement to the rod 51 and actuates the boom lift actuator 50 for raising the boom of the roof drilling and bolting machine 100. Similarly, imparting a manual force to the lever knob 34 and the lever 33 in a second longitudinal direction imparts movement to the actuating rod 40 and the rod 51 in an opposite direction to the first longitudinal direction, thereby causing the boom lift actuator 50 to lower the boom. Once an operator releases the lever knob 34, the spring 56 will return the actuating rod 40 to a neutral position. If an operator imparts a manual force to the lever knob 34 to rotate the lever 33 in a first direction orthogonal to the longitudinal direction of the actuating rod 40, the bracket 20, sleeve 16 and bracket 18 are rotated to a limited extent. This rotational movement will impart a movement to the rod 53, thereby actuating the rotational actuator 62 to rotate a pot in a clockwise direction. An operator applying a manual force to the lever knob 34 and lever knob 33 in a second direction opposite to the first direction yet still orthogonal to the longitudinal direction of the actuating rod 40 will rotate the bracket 20, sleeve 16, and bracket 18 in a second direction, thereby imparting motion to the rod 53 and actuating the rotational actuator 62 to cause the pot to rotate in a counterclockwise direction. Again, releasing the manual force from the lever knob 34 and the lever 33 will permit the spring 57 to return the bracket 18, sleeve 16 and bracket 20 to a neutral position so that the pot is not rotated in either a clockwise or a counterclockwise direction.

An operator using the roof drilling and bolting machine would first position the machine in a suitable location adjacent to an area for drilling. Thereafter, the individual would actuate the lever knob 34 and lever 33 to raise the boom to a suitable position to start drilling. Thereafter, a steel drill bit would be inserted into the pot and the actuating lever would be rotated to cause the pot to impart a rotational movement to the drill bit. At the same time, the operator would exert a longitudinal force on the lever knob 34 and lever 33 to advance or feed the drill bit upwardly as it rotates. The multi-function control actuating mechanism according to the present invention permits an individual to advance and rotate a drill bit by utilizing only a single hand. After a hole is drilled into the roof, a roof bolt together with an adequate mixture of resin and hardener are positioned in the hole and the head of the bolt is mounted on the pot and the multi-function control actuating mechanism is again actuated to rotate and raise the roof bolt so as to secure the roof bolt to the roof of the mine. Thereafter, a frame can be secured to the roof bolt.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A multi-function control actuating mechanism for a roof drilling and bolting machine comprising:

an actuating rod having a first end and a second end, said actuating rod being of a predetermined length and being mounted for movement in a longitudinal direction;

a sleeve having a first end and a second end, said sleeve being mounted for limited rotational movement and being positioned around said actuating rod and extending along a portion of the length thereof;

first bracket means being secured adjacent to a first end of said sleeve;

second bracket means being secured adjacent to a second end of said sleeve; and an actuating lever operatively connected to said second bracket and to a second end of said actuating rod;

wherein selectively imparting movement in a first direction to said actuating lever imparts longitudinal movement to said actuating rod and selectively imparting movement in a directional orthogonal to said first direction imparts limited rotational movement to said second bracket mean, said sleeve and said first bracket means for providing a multi-function control actuating mechanism for a roof drilling and bolting machine.

2. A multi-function control actuating mechanism according to claim and further including a coupling operatively connected to said first end of said actuating rod for securing said actuating rod to a boom lift actuator.

3. A multi-function control actuating mechanism according to claim 2, wherein force applied to said lever imparts movement to said actuating rod in a first longitudinal direction for imparting movement to said boom lift actuator for lifting a boom and force applied to said lever imparting movement to said actuating rod in a second longitudinal direction imparts movement to said boom lift actuator for lowering said boom.

4. A multi-function control actuating mechanism according to claim 3, and further including restoring means operatively connected to said actuating rod for returning said rod to a neutral position after said force is released from said lever.

5. A multi-function control actuating mechanism according to claim 4, wherein said restoring means is a spring.

6. A multi-function control actuating mechanism according to claim 1, and further including at least one bushing mounted between said sleeve and said actuating rod for permitting relative longitudinal and rotational movement therebetween.

7. A multi-function control actuating mechanism according to claim 6, wherein a bushing is provided adjacent to each end of said sleeve.

8. A multi-function control actuating mechanism according to claim 1, and further including at least one flange member projecting outwardly from said first bracket means.

9. A multi-function control actuating mechanism according to claim 1, and further including a rotational actuator operatively connected to said first bracket member, wherein force applied to said actuating lever in a first direction orthogonal to said longitudinal direction imparts movement to a pot to rotate said pot in a clockwise direction and force applied to said actuating lever in a second direction orthogonal to said longitudinal direction imparts movement to said pot to rotate said pot in a counter-clockwise direction.

10. A multi-function control actuating mechanism according to claim 9, and further including restoring means operatively connected to said rotational actuator for returning said rotational actuator to a neutral position after said force is released from said lever.

* * * * *